US006792634B1

(12) United States Patent
Mills et al.

(10) Patent No.: US 6,792,634 B1
(45) Date of Patent: Sep. 21, 2004

(54) PLIABLE MEMBRANE INSTALLATION TOOL

(76) Inventors: Roger Mills, 8725 W. Orange Tree St., Crystal River, FL (US) 34428; Les Rosenka, 10220 S. Buckskin Ave., Floral City, FL (US) 34436

( * ) Notice: Subject to any disclaimer, the term of this patent is extended or adjusted under 35 U.S.C. 154(b) by 0 days.

(21) Appl. No.: 10/377,347

(22) Filed: Feb. 28, 2003

(51) Int. Cl.[7] ..... A47G 27/04; B26B 11/00
(52) U.S. Cl. ..... 7/103; 7/158; 81/488
(58) Field of Search ..... 7/103, 158; 81/488; 30/139

(56) References Cited

U.S. PATENT DOCUMENTS 3,382,579 A 5/1968 Prater
3,546,726 A * 12/1970 Bizzigotti ..... 7/103
3,737,932 A 6/1973 Armijo
3,934,341 A * 1/1976 Carlson ..... 30/287
5,438,757 A * 8/1995 Weschenfelder ..... 30/139
5,984,392 A * 11/1999 Iannacone, Jr. ..... 294/8.6
6,226,824 B1 * 5/2001 Hopson et al. ..... 7/158

* cited by examiner

*Primary Examiner*—Joseph J. Hail, III
*Assistant Examiner*—David B. Thomas

(57) ABSTRACT

A pliable membrane installation tool comprised of a body-base with handle, prongs to provide support for a stay-wheel axle with a stay-wheel, anti-snag wheel and washer-spacer (all with rotational freedom), and a wall guide with a cut-and-tuck member integrated with a means for cutting. A guide wheel and tucking wheel on the wall guide provide for the staying, cutting and tucking of the pliable membrane to be installed in one easy movement along the wall by the operator.

20 Claims, 5 Drawing Sheets

PLIABLE MEMBRANE INSTALLATION TOOL

BACKGROUND OF THE INVENTION

This invention relates generally to a tool (an article of manufacture) and method of use. The present invention particularly relates to tools used for efficient installation of pliable membranes (defined as all types of carpet, vinyl, floor coverings, wallpaper, wall coverings and the like, known now or known in the future) onto sub-floor (or wall or ceiling) systems (concrete, wood and all others) in structures (homes, offices and any other type of buildings, structure or surface) and onto any other type of planar or non-planar surface.

DESCRIPTION OF THE PRIOR ART

The pliable membrane building trade (carpet, vinyl and the like) has long been a result of customs and practices handed down from masters to apprentices through on-the-job training. These customs and practices employ four basic tools that have been in use for 50 or 60 years and these types of tools are commonly used for the installation of carpet and vinyl floor coverings in the building trades. With carpet, for example, the custom and practice in this trade is to use four separate tools to accomplish the installation; a kicker, knife, stay tool and tuck tool. This results in an inefficient method of installation requiring a two-person crew and four separate trips along one side of a sub-floor surface to complete the installation of just one side; one to kick and preliminary stay (attach to the carpet tack-strip), one to stay securely with the stay tool, one to cut the carpet and another to tuck the cut edge into the comer defined by the sub-floor and wall (with or without baseboard).

Attempts in the past have not solved this inefficient method of installation. U.S. Pat. No. 3,737,932 discloses a carpet trimming and finishing device that has no stay wheel, no anti-snag wheel, no pliable membrane curvature edge and no guide wheel. Pat. No. 3,382,579 discloses only a fold down handle for carpet trimmers.

This new and useful invention solves installation problems, reduces the labor required to one person and one trip down the edge of the carpet, versus two persons and four trips down the edge of the carpet. This invention allows one crewmember to kick, cut, stay and tuck the carpet in one smooth motion. This one, quick and efficient step accomplishes a superior installation in one-fourth of the amount of time required by traditional methods. These solutions include (in the preferred embodiment): 1) Stay wheels to stay the carpet before and after cutting. 2) Tuck wheel and tuck wheel guide to tuck the carpet before and after cutting. 3) Multi-purpose design that allows use for vinyl and other types of pliable membrane surfaces used for flooring and other uses.

BRIEF SUMMARY OF THE INVENTION

It is an object of this invention to reduce the costs associated with the installation of pliable membranes such as carpet and vinyl flooring by saving time and labor during installation. It is another object of this invention to reduce the man-power needed for flooring installation crews.

The objects of this invention are achieved, in a preferred embodiment, which provides an implement comprising a rigid horizontal planer body-base of a suitable length, width and thickness with at least one rigid vertical planer prong on at least one end of the longitudinal axis to provide support for at least one stay wheel on at least one stay wheel axle on at least one end. Integral with the body-base is a rigid horizontal cut-and-tuck planer member, with at least one knife-blade as a cutting means and rigid vertical planer wall guide, off-set from and parallel to the longitudinal axis of the body-base, disposed on which at least one guide wheel and tucking wheel are affixed. A curvature edge is disposed on the vertical planer prong to curve the pliable membrane to be cut. When a pliable membrane is laid flat on a sub-floor with excess membrane placed against the wall of a sub-floor system, the edge of the pliable membrane is inserted into the cutting slot and the tool is then moved laterally against the edge of the pliable membrane by the user's hand grasping the handle and applying force in the longitudinal direction across the pliable membrane surface to be installed. In one smooth motion the invention stays, cuts and tucks once and then tucks and stays again in the same motion. Spacers are provided for use with thin or thick pliable membranes. In a preferred embodiment the invention can be used by either right or left-handed persons without modification. This tool is lightweight, compact and of simple construction that is easy to make and use while reducing the likelihood of injuries to the operator due to the protected cutting means employed.

DETAILED DESCRIPTION OF THE PREFERRED EMBODIMENT

The apparatus of the invention is conveniently fabricated by conventional and standard methods of machining, welding or molding in the metal fabrication and machining arts using conventional and standard materials.

For example, the body-base and incorporated components may be fabricated from aluminum, steel or other like metals or any other suitable material as will be readily apparent to one of ordinary skill in the art. The present invention (or components of) may also be fabricated from non-metallic materials for lighter weight and resistance to corrosion. These non-metallic materials include, among others, conventional polymers such as, for example, polystyrene, polycarbonate, polyurethane, polyethylene, phenol formaldehyde resins, polybutylene, Teflon and the like. The cutting means may be razor blades, sharpened edges, laser beam, heated wire or ultrasonic beam, for example.

Figure 1:
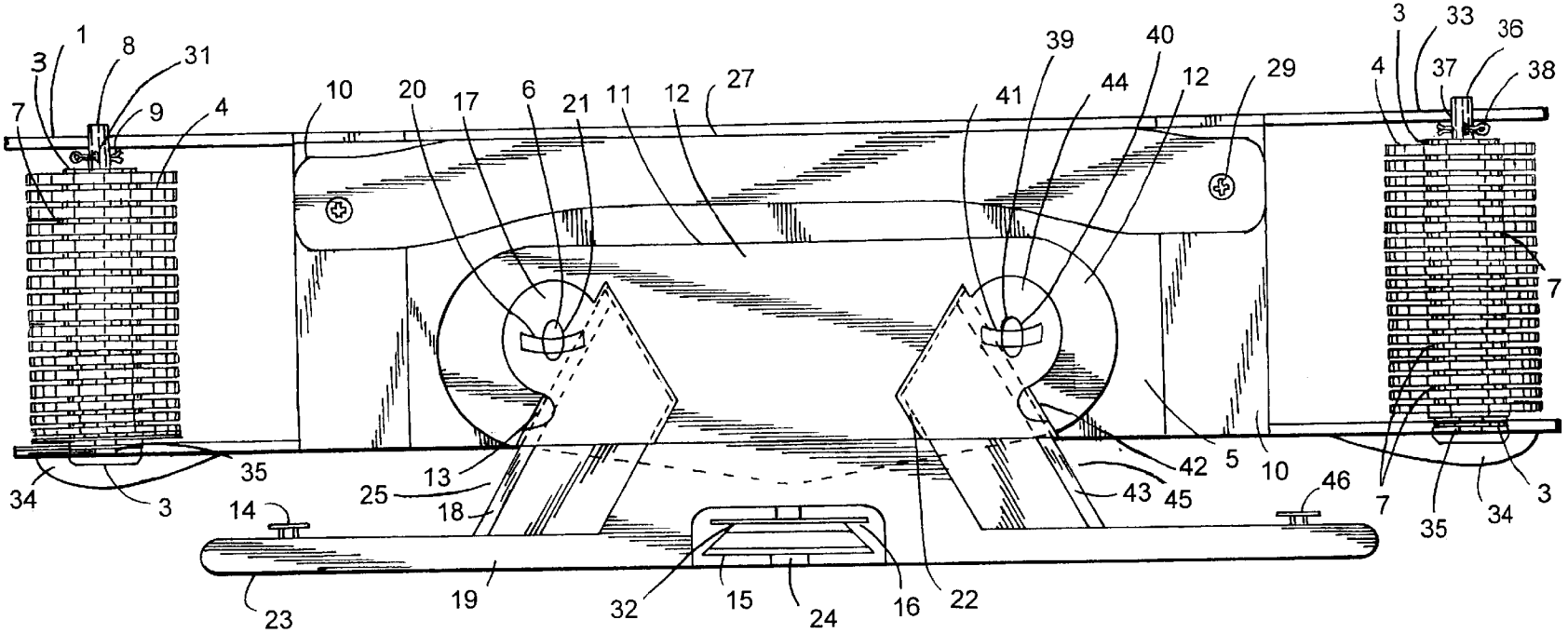
FIG. 1 is a top view of an embodiment of a pliable membrane installation tool (with partial hidden view of the cutting means and spacers) constructed in accordance with the present invention.

The apparatus (tool) and method of using the invention will now be further described and exemplified by reference to a preferred embodiment as set forth in the drawings, and to describe with a floor as the surface upon which a pliable membrane, such as carpet of vinyl flooring, is to be applied. FIG. 1 is a view of a preferred embodiment of the invention as seen from the top. Typically a user will grasp the handle with one hand, and the handle 26 attaches to the body-base 5 via the handle attach screw(s) 28 onto the base for handle 10. The pliable membrane is laid flat on the sub-floor with excess membrane placed against the wall of a sub-floor system, and the edge of the pliable membrane is inserted into the cutting means, wall guide 19 placed in contact or nearly in contact with the wall and then the tool is moved laterally by the user's hand grasping the handle and applying force in the longitudinal direction across the pliable membrane surface to be installed. As the user moves the tool parallel to the wall surface (keeping the wall guide 19 in contact or nearly in contact with the wall) along the corner-cavity defined by the wall and sub-floor surface, in one smooth motion the invention stays, cuts and tucks once and then tucks and stays again in the same motion. For carpet with a tack-strip, for instance, the operator would kick and stretch the carpet with a kicker just ahead of the tool. The body-base 5 comprises a platform for the integration on one end of the first prong-pair 1 and first carpet-curvature edge 2 with first stay-wheel axle end hole 29 which acts as support for the first stay-wheel axle 8 (which is placed through the first stay-wheel axle entry hole 30) upon which are disposed at least one stay wheel 4 and at least one anti-snag wheel 3 (with at least one washer-spacer 7 in between), all with rotational freedom. The first cotter-pin 9 secures the first stay-wheel axle 8 into the first prong-pair 1 and enables the stay wheel(s) 4 to be removed for cleaning. The first bolt 6 (through the first bolt hole 21) and first wing nut 20 secure the cut-and-tuck body 12 on at least one spacer 11 (as needed, depends on thickness of pliable membrane to be installed) and the first blade slot 13 holds the first cutting blade 18 in the first blade holder 17 for cutting the membrane when the membrane is forced into the first cutting slot 24 by pressure from the hand of the installer on the handle 26 and against the pliable membrane being installed. The wall guide 19 has the first guide wheel 14 and second guide wheel 45 on the inside surface. The non-marking layer 22 is affixed for prevention of scratching the wall or baseboard during installation. The tuck wheel axle 23 is integrated into the cut-and-tuck body 12 and wall guide 19 upon which is attached the tucking wheel 15 (which is stepped to force the carpet, for example, against the wall in small increments) and also allows at least one tucking wheel spacer 31 to be placed on the tuck wheel axle (to allow for different thicknesses of pliable membrane) between the tuck wheel guide 16 and the tucking wheel 15.

The body-base 5 comprises a platform for the integration on the opposite end of the second prong-pair 32 and second carpet-curvature edge 33 with second stay-wheel axle end hole 34 which acts as support for the second stay-wheel axle 35 (which is placed through the second stay-wheel axle entry hole 36) upon which are disposed at least one stay wheel 4 and at least one anti-snag wheel 3 (with at least one washer-spacer 7 in between), all with rotational freedom. The second cotter-pin 37 secures the second stay-wheel axle 35 into the second prong-pair 32 and enables the stay wheel(s) 4 to be removed for cleaning. The second bolt 38 (through the second bolt hole 39) and second wing nut 40 secure the cut-and-tuck body 12 on the at least one spacer 11 (as needed, depends on thickness of pliable membrane to be installed) and the second blade slot 41 holds the second cutting blade 42 in the second blade holder 43 for cutting the membrane when the membrane is forced into the second cutting slot 44 and against the pliable membrane being installed by pressure from the hand of the installer in the opposite direction than the first cutting slot 24. This allows for operation of the tool with either hand and in either direction of the longitudinal axis of the tool. The wall guide 19 with non-marking layer 22 affixed for prevention of scratching the wall or baseboard during installation. The tuck wheel axle 23 is integrated into the cut-and-tuck body 12 and wall guide 19 upon which is disposed the tucking wheel 15 (which is stepped to force the carpet, for example, against the wall in small increments and also allows at least one tucking wheel spacer 31 to be placed on the tuck wheel axle to allow for different thicknesses of pliable membrane) and second guide wheel 45 for guidance. Again, this allows for operation of the tool with either hand and in either direction of the longitudinal axis of the tool. All components may be referenced in plural for convenience, as only at least one of all components are necessary for proper operation and use in other embodiments.

Figure 2:
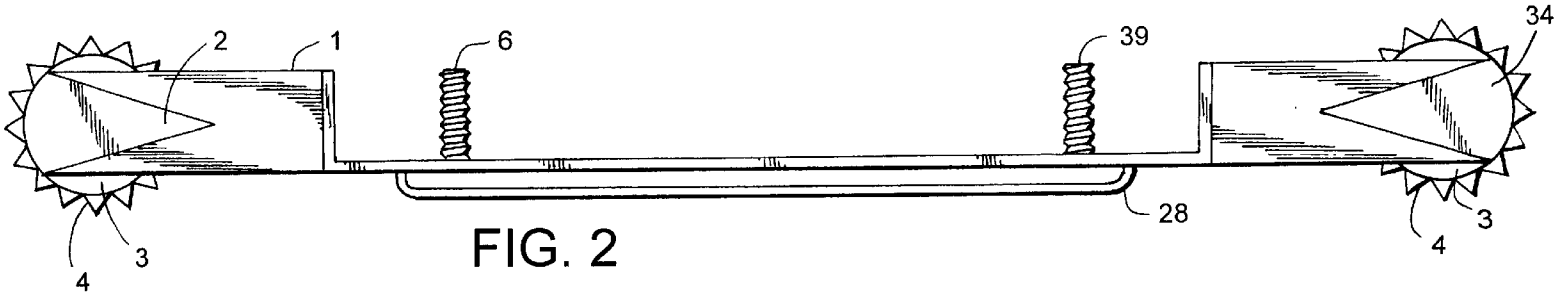
FIG. 2 is side view of the body-base element and components of the tool depicted in FIG. 1.

Now referring to FIG. 2, the body-base 5 is shown in side view with the integrated first bolt 6 and second bolt 38 on top and friction-reducing skid 27 on bottom, disposed thereon. Also shown is the integration of the first prong-pair 1, second prong-pair 32, first carpet-curvature edge 2 and second carpet-curvature edge 33 with the stay wheel(s) shown protruding past the end of the prong-pair(s) (1 and 32).

Figure 3:
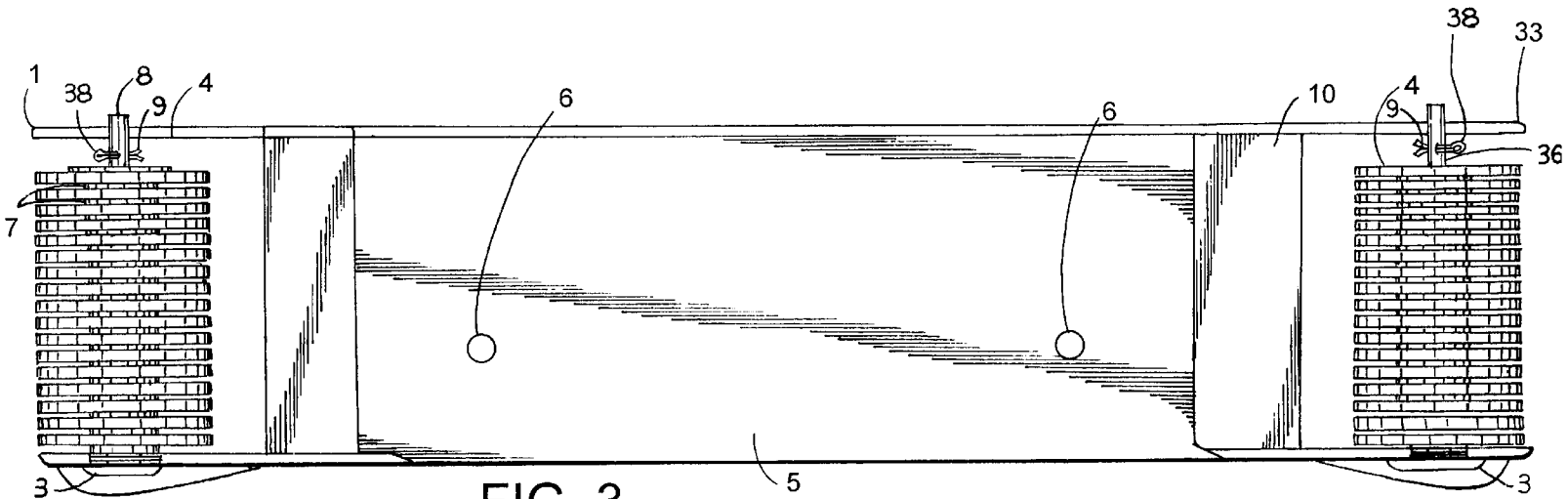
FIG. 3 is a top view of the body-base element and components of the tool depicted in FIG. 1.

Now referring to FIG. 3, the body-base 5 is shown in top view with the integrated first bolt 6 and second bolt 38 on top and base for handle 10, welded thereon. Also shown is the top view of the integration of the first prong-pair 1, second prong-pair 32, first carpet-curvature edge 2 and second carpet-curvature edge 33, between each of which are disposed the stay wheel(s) 4, washer-spacer(s) 7 and anti-snag wheel(s) 3 (with rotational freedom) on the first stay-wheel axle 8 and secured by the cotter-pin 9, as well as the second stay-wheel axle 35 secured by the second cotter-pin 37.

Figure 4:
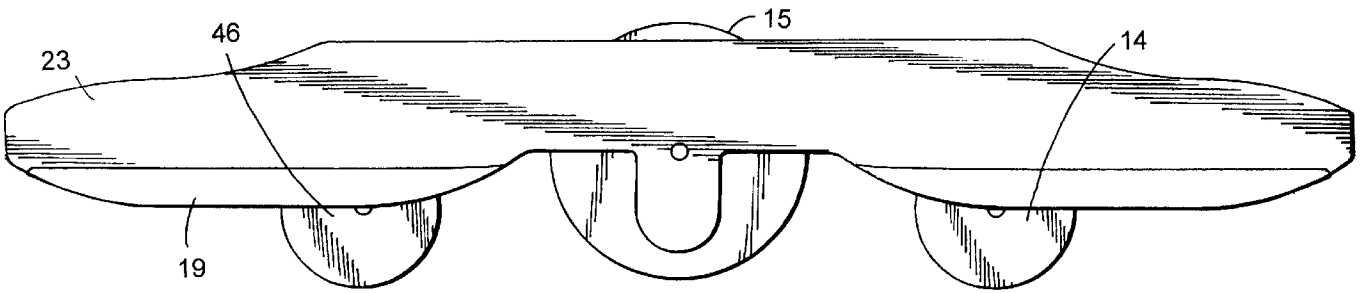
FIG. 4 is a side view of the exterior side of the wall guide element with tucking wheel and each guide wheel of the tool depicted in FIG. 1.

FIG. 4 depicts the outside (relative to the body-base 5) of the wall guide 19 with non-marking layer 22 affixed and first and second guide wheel(s) (14 and 45) and tucking wheel 15 disposed thereon on the inside surface of the wall guide 19, such that when placed upon the wall surface which defines the area of the floor surface to be covered, the wall guide 19 keeps alignment of the cut edge of the membrane and tucking wheel tucks the membrane edge against the wall.

Figure 5:
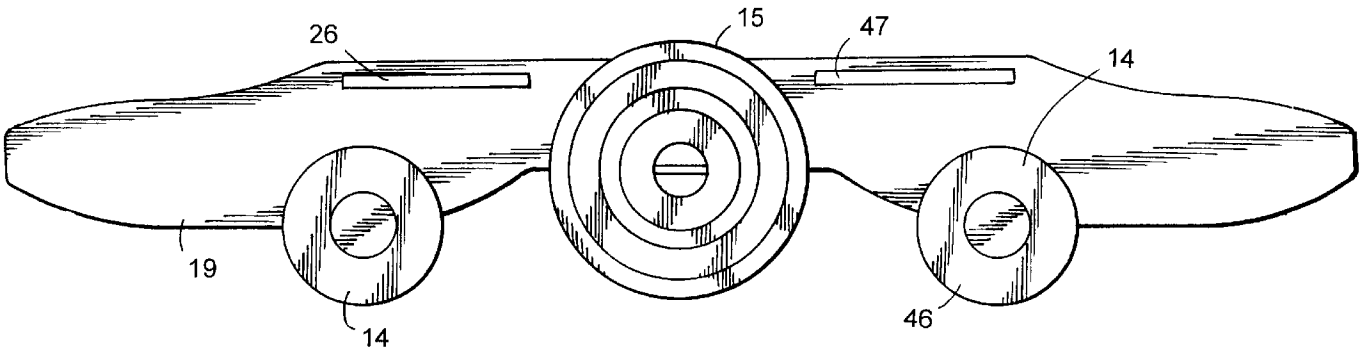
FIG. 5 is a side view of the interior side of the wall guide element with tucking wheel and guide tuck wheel of the tool depicted in FIG. 1.

FIG. 5 depicts the inside (relative to the body-base 5) of the wall guide 19 with first and second guide wheel(s) (14 and 45), tucking wheel 15 and first blade holder end slot 25 and second blade holder end slot 46 cut into the inside surface of the wall guide 19, such that when placed upon the wall surface which defines the area of the floor surface to be covered, the wall guide 19 keeps alignment of the cut edge of the membrane and tucking wheel tucks the membrane edge against the wall.

Figure 6:
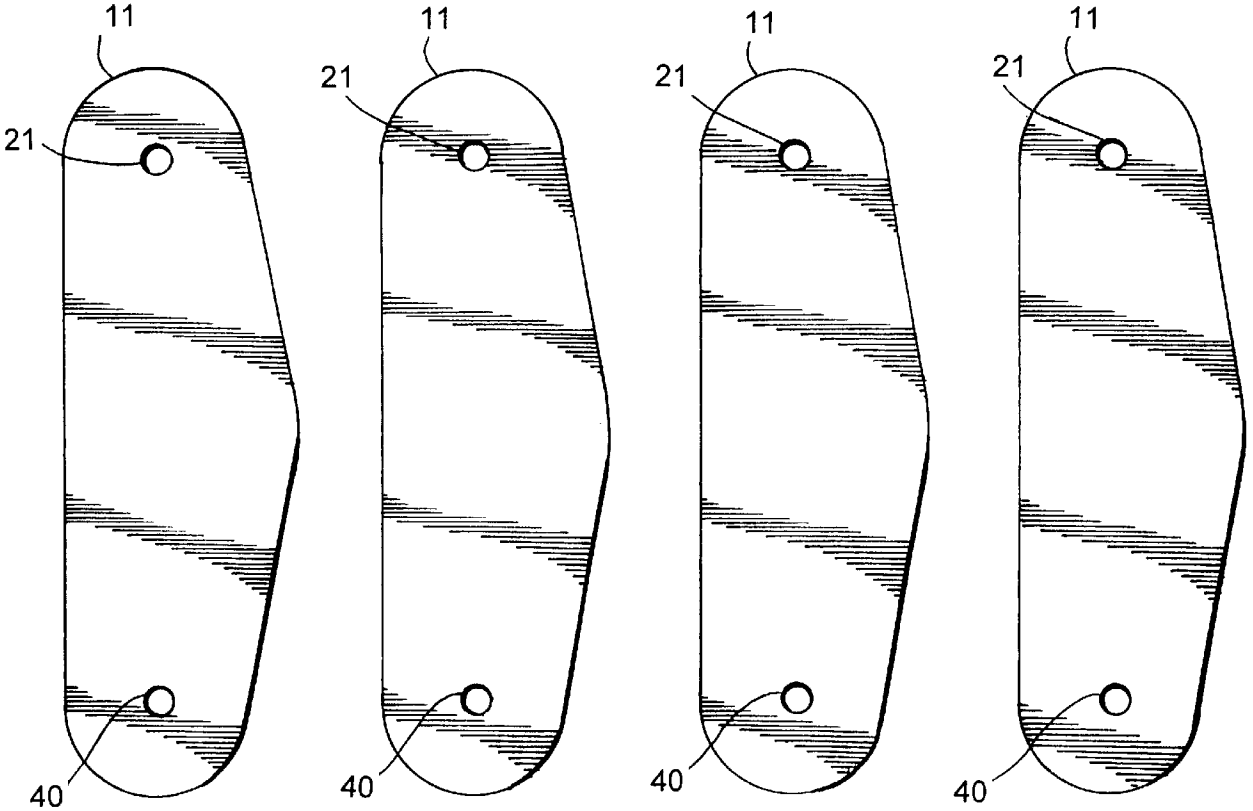
FIG. 6 is a top view of the optional spacers (4 are shown for example) disposed on the rigid horizontal cut-and-tuck planer member of the tool depicted in FIG. 1.

FIG. 6 illustrates typical spacers 11 with first and second bolt hole(s) (21 and 39) integrated therein to allow the spacers to be placed on the first bolt 6 and second bolt 38 to allow for different heights (thicknesses) of membranes to be cut by the cutting blade(s) (18 and 42) as needed. 4 spacers 11 are shown as examples only.

Again referring to FIG. 1, the assembly and fabrication of the preferred embodiment of the invention will be described in detail. The tool is assembled and fabricated from standard materials and methods now used in the carpet installation tool industries. Typically, the body-base 5 and integrated components are constructed from steel or aluminum which is fabricated using standard machine shop techniques such as welding, drilling, cutting, smoothing and polishing. Or, these components (or all components) may be injection molded from non-metallic materials as previously mentioned. The handle 26 may alternately be made of wood. The stay wheel(s) 4, washer-spacer(s) 7, bolt(s) (6 and 38), first and second stay-wheel axles axels (8 and 35), wing nut(s) (20 and 40), cotter-pin(s) (9 and 37) and handle attach screw(s) 28 may be obtained from off-the-shelf components in the hardware industry, or custom fabricated. The cutting blade(s) (18 and 42) may be commonly available single-edged razor blades.

Now referring to FIG. 2 and FIG. 3, assembly of the apparatus is commenced with the fabrication of the body-base 5 and integration by welding of the first and second bolt(s) (6 and 38), first and second prong-pair(s) (1 and 32), first and second carpet-curvature edge(s) (2 and 33), and friction reducing skid 27 thereon as depicted in the drawings.

Figure 7:
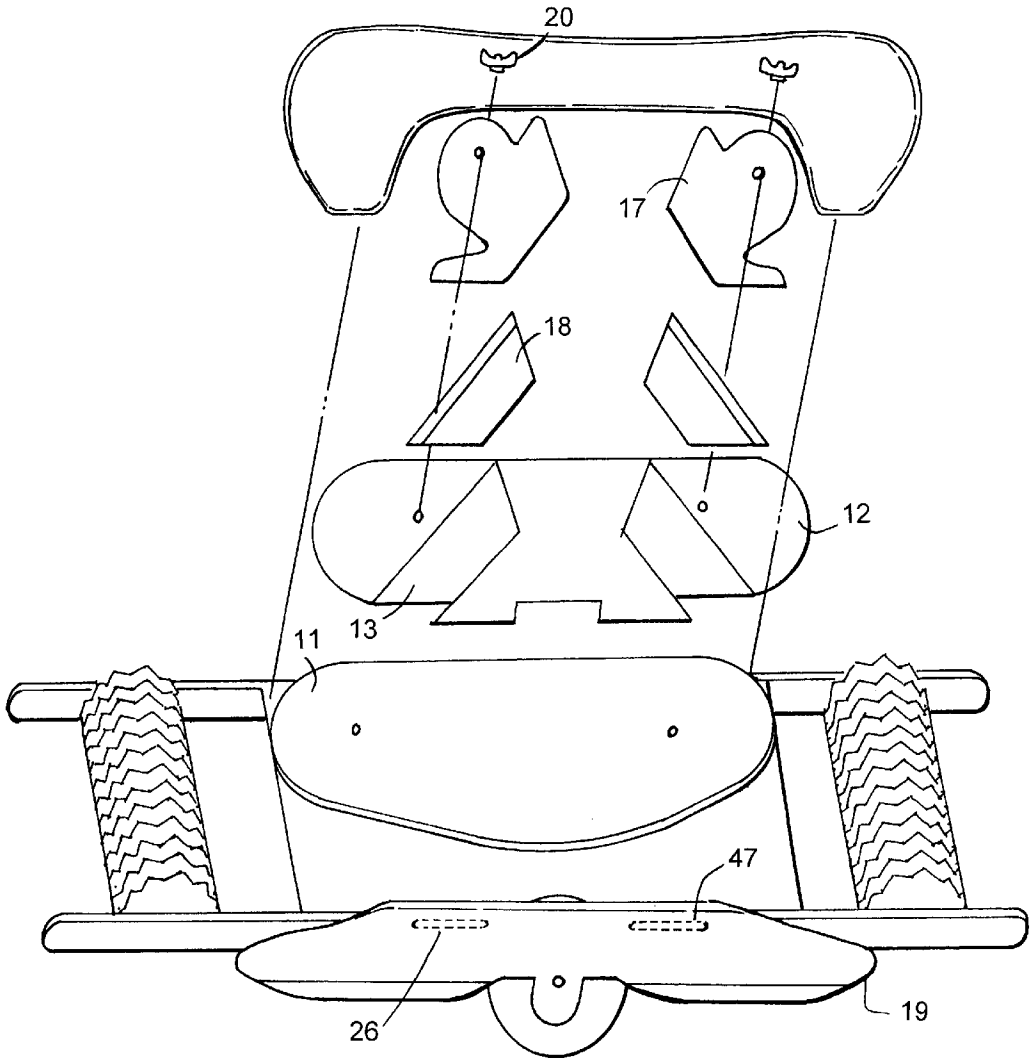
FIG. 7 is an "exploded" view of the cut-and-tuck body, cutting blade, bolt, blade holder and handle as integrated onto the body-base with wall guide.

As shown in FIG. 7, the wall guide 19 is typically welded to the cut-and-tuck body 12 (containing the tucking wheel 15 and first and second guide wheel(s) (14 and 45) and the first and second blade holder end slot(s) (25 and 46—shown in "hidden view"). At least one spacer 11 is cut from metal (or injection molded) and the first and second bolt hole(s) (21 and 39) drilled and then placed on the first and second bolt(s) (6 and 38), as well as the cut-and-tuck body 12 with first and second cutting blade(s) (18 and 42), and first and second blade holder(s) (17 and 43), all of which are secured on the first and second bolt(s) (6 and 38) by the first and second wing nut(s) (20 and 40). The handle 26 is attached to the handle base 10 with the handle attach screw(s) 28. The anti-snag wheel(s) 3, stay wheel(s) 4 and washer-spacer(s) 7 are disposed on the first and second stay-wheel axles(s) (8 and 35) (with rotational freedom), the first and second stay-wheel axle(s) (8 and 35) placed in the first and second stay-wheel axle entry hole(s) (30 and 35) and each pushed through until they seat in the stay-wheel axle end hole(s) (29 and 34), then secured with the first and second cotter pin(s) (9 and 37).

Although the foregoing invention has been described in some detail by way of illustration and example, it will be understood that the present invention is not limited to the particular description and specific embodiments described but may comprise any combination of the above elements and variations thereof, many of which will be obvious to those skilled in the art. Instead, the invention is limited and defined solely by the following claims.

What is claimed:

1. A tool comprising:

a rigid horizontal planar body-base of a suitable length, width and thickness having on at least one end of the longitudinal axis of the body-base at least one extension of a rigid vertical planar element (prong) to provide support for at least one stay-wheel axle;

at least one stay wheel with rotational freedom disposed on said stay-wheel axle;

a handle integrally connected to the top surface of the body-base;

a rigid cut-and-tuck horizontal planar member disposed on the top surface of said body-base adjacent to said handle;

a cutting means connected to the cut-and-tuck horizontal planar member;

a rigid vertical planar wall guide disposed on said cut-and-tuck member extended to one side of the longitudinal axis of said body-base to define a cutting slot;

at least one tucking wheel with rotational freedom disposed on said wall guide;

at least one guide wheel disposed on said wall guide adjacent to said tucking wheel whereby when said body-base with said wall guide is placed on top of a pliable membrane surface to be installed on a sub-floor surface with excess membrane curved up the wall, and the edge of the excess pliable membrane inserted into the cutting slot, the outside surface of said wall guide is contacted or nearly contacted to the wall and the tool pushed with force along the wall, the stay wheel stays, the guide wheel guides, cutting means cuts and tucking wheel tucks the cut edge of the pliable membrane to accomplish a finished installation of the edge of the pliable membrane in one trip along the wall.

2. The tool of claim 1, further comprising at least one spacer disposed between the top of said body-base and the bottom of said cut-and tuck horizontal planer member with at least one cutting means holder.

3. The tool of claim 1, wherein the cutting means holder is a blade holder.

4. The tool of claim 1, wherein the rigid vertical planer element is a prong-pair.

5. The tool of claim 1, wherein at least one anti-snag wheel on the stay-wheel axle is disposed between the stay-wheel and one prong of the prong-pair.

6. The tool of claim 1, wherein at least one carpet-curvature edge is disposed on the outside surface of at least one prong of the prong-pair.

7. The tool of claim 1, wherein the disposition means for securing the spacer, cut-and-tuck body and cutting means holder is at least one bolt through at least one bolt hole in said spacer, cut-and-tuck body and cutting means holder, all secured with a wing nut.

8. The tool of claim 1, wherein the cutting means is a cutting blade.

9. The tool of claim 1, wherein a blade slot is cut into the cut-and-tuck body for insertion of the cutting blade to be compressed between the cut-and-tuck body and blade holder by the wing nut on the bolt.

10. The tool of claim 1, wherein a base for handle is provided on the top of the body-base.

11. The tool of claim 1, wherein a cotter-pin secures the stay-wheel axle in the prong-pair.

12. The tool of claim 1, wherein the tucking wheel is disposed on a tucking wheel axle with rotational freedom.

13. The tool of claim 1, wherein a tuck wheel guide is also disposed on the tuck wheel axle with at least one tucking wheel spacer disposed between the tucking wheel and tuck wheel guide to allow for different thicknesses of pliable membrane.

14. The tool of claim 1, wherein the tucking wheel is stepped to tuck the membrane in incremental steps.

15. The tool of claim 1, wherein the stay wheel axle is inserted through at least one stay-wheel axle entry hole and seated into at least one stay-wheel axle end hole.

16. The tool of claim 1, wherein a blade holder end slot is cut into the inside surface of the wall guide to hold the cutting blade end securely.

17. The tool of claim 1, wherein a friction reducing skid is disposed on the bottom surface of the body-base.

18. The tool of claim 1, wherein the connection means to integrally connect the handle to the body-base is at least one handle attach screw.

19. The tool of claim 1, wherein the outside circumference edge of the stay wheel is serrated.

20. The tool of claim 1, wherein a non-marking layer is affixed to the outside surface of the wall guide to prevent scratching or marking of the wall.

* * * * *